United States Patent [19]

Ahn

[11] 4,372,362

[45] Feb. 8, 1983

[54] TOOL

[76] Inventor: Min H. Ahn, 5111 Maple Rd., Richmond, British Columbia, Canada

[21] Appl. No.: 237,175

[22] Filed: Feb. 23, 1981

[51] Int. Cl.[3] ..... B25G 1/08

[52] U.S. Cl. ..... 145/63; 81/177M; 145/62; 145/75

[58] Field of Search ..... 145/63, 62, 75, 64; 81/177 M, 62, 60

[56] References Cited

U.S. PATENT DOCUMENTS

| | | | |
|---|---|---|---|
| 435,890 | 9/1890 | Franklin | 145/62 |
| 2,749,953 | 6/1956 | Rundle | 145/63 |
| 2,765,013 | 10/1956 | Pedersen | 145/63 |
| 3,194,286 | 7/1965 | Wagner | 145/63 |

FOREIGN PATENT DOCUMENTS

| | | | |
|---|---|---|---|
| 163627 | 4/1934 | Switzerland | 145/62 |

*Primary Examiner*—Donald R. Schran

*Attorney, Agent, or Firm*—Townsend and Townsend

[57] ABSTRACT

A tool having a housing with a plurality of bits located within the housing. Each bit has a working end to protrude from the housing and an inner end in the housing. There is a pathway in each bit adjacent the inner end. An opening in the housing allows a bit to protrude. That bit can be gripped to hold it in place. Second openings are positioned in the housing and shafts extending through each second opening and through a pathway in a bit. Each bit is urged radially outwardly, for example by a spring. A bit may be selected by pushing on its shaft and moving the shaft downwardly towards the opening. The bit is then gripped in place with its working end protruding from the opening in the housing.

12 Claims, 5 Drawing Figures

TOOL

FIELD OF THE INVENTION

This invention relates to a tool able to stock a plurality of bits to be used as part of the tool. Although the tool may be useful as a light duty drill and the like it is principally useful as a screwdriver.

DESCRIPTION OF THE PRIOR ART

The most common form of screwdriver is a simple blade permanently attached to a handle. A large number of screwdrives must be owned by the craftsman as in addition to different sizes of blades there are also different types of blades, for example slot and Phillips.

Screwdrivers and the like having a magazine of blades are known. Generally speaking such screwdrivers have a housing for the blades which are removed from the housing as required, and inserted into a chuck at the base of screwdriver. The chuck is tightened and the device is then ready to use. Such a device has the disadvantage of being time consuming to use in that the chuck must be released, the blade removed, the lid of the housing removed, a fresh bit selected, the old bit stored, the fresh bit fastened in the chuck and the lid fastened on the handle. Furthermore, the bits not in use can rattle around in the handle.

It is also possible for the use of a conventional screwdriver to cause sore wrists by virtue of the rotating action required.

SUMMARY OF THE INVENTION

The present invention seeks to produce a screwdriver in which a plurality of bits are used and in which the bits can be changed with great ease. Furthermore, in a desirable aspect the screwdriver includes a mechanism that permits rapid rotation, with the minimum harm to the wrist, to tighten or loosen a screw.

Accordingly, in a first aspect, the present invention is a tool comprising a housing; a plurality of bits located within the housing, each bit having a working end to protrude from the housing and an inner end located in the housing; a pathway in each bit adjacent said inner end; a first opening in the housing to allow a preselected bit to protrude; means to grip the preselected bit; a plurality of second openings, positioned circumferentially of the housing and extending longitudinally of the housing; a plurality of shafts, each extending through an associated second opening and through a pathway in a bit; resilient means on each shaft urging each bit radially outwardly; whereby a bit may be selected by pushing on its associated shaft and moving the shaft downwardly towards the first opening, the gripping means then being operated to grip the selected bit with its working end protruding from the first opening in the housing.

In a preferred aspect the device includes means to lock the tool so that it drives either clockwise or anticlockwise but not both.

BRIEF DESCRIPTION OF THE DRAWINGS

Aspects of the invention are illustrated, merely by way of example, in the accompanying drawings in which.

DESCRIPTION OF THE PREFERRED EMBODIMENTS

Figure 1:
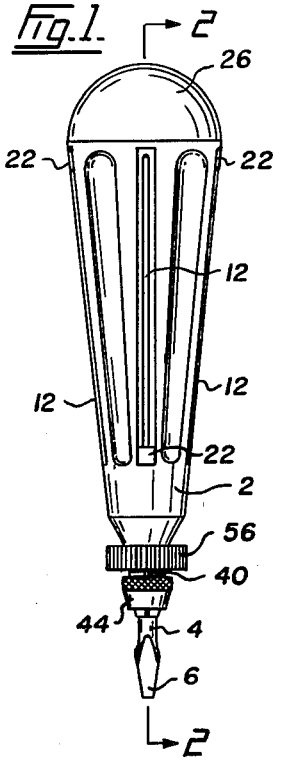
FIG. 1 is a view of the tool according to the present invention in the form of a screwdriver.

The drawings illustrate a tool according to the present invention in the form of a screwdriver. The screwdriver comprises a housing 2 with a plurality of bits 4 located within it. As indicated the bits may have any type of working ends. For example Phillips, Robertson and a slot screwdriver blade are illustrated. Each bit thus has a working end 6, that is the end that engages the screw, and an inner end 8 that is always located within the housing 2. There is a first opening 10 in the housing which allows a preselected bit to protrude, a bit 4 being shown in FIGS. 1 and 2 in the protruding, useful position. There are also a plurality of second openings 12 which are disposed circumferentially about the housing 2 and run, as most clearly shown in FIG. 2, longitudinally of that housing. In the illustrated embodiment there are six such second openings 12—see FIG. 3. There is a pathway 14 in each bit 4 adjacent the inner end 8. A plurality of shafts 16, one to each bit 4, each extend through a second opening 12 and through a passageway 14 in an associated bit 4. A coil spring 18 on each shaft 16 urges each bit 4 radially outwardly. Each shaft 16 is formed at its inner end with a stop 20 for the spring 18. At the other end of the shaft 16 there is a knob 22 to facilitate movement of the shaft 16 with the finger and also to prevent the shaft 16 being forced inwardly into the housing 2. In the illustrated preferred embodiment there is also a small leaf spring 24 formed on each shaft 16 which is to prevent freeplay, and thus rattling, of the bits 4 by movement longitudinally on the shafts 16.

Figure 2:
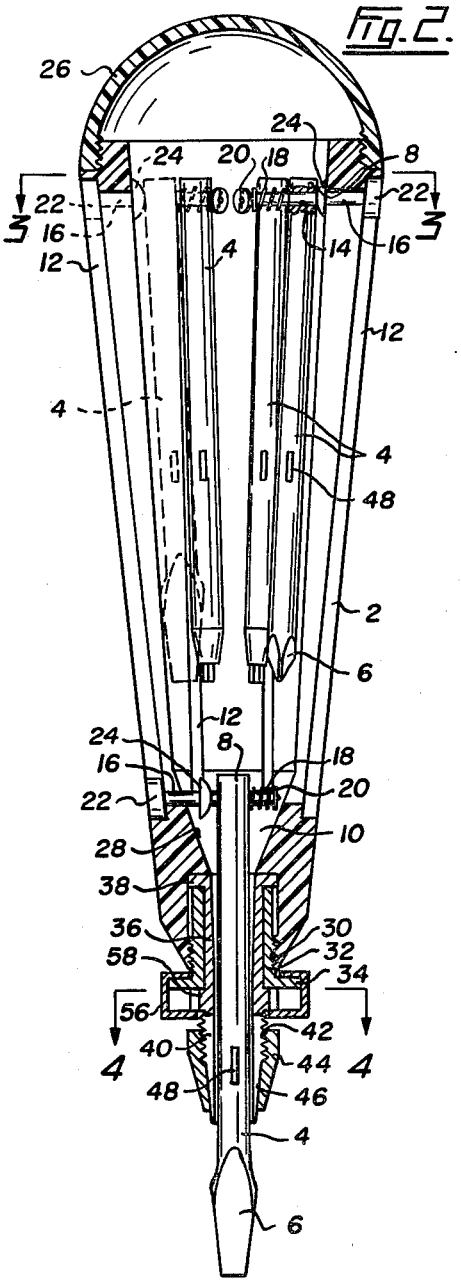
FIG. 2 is a section along the line 2—2 in FIG. 1 to a different scale.

As shown particularly in FIG. 2 the housing is formed with a cap 26 that is threadedly engaged on the housing 2. The interior of the housing 2 is also sloped downwardly as shown in FIG. 2 at 28 to guide a preselected bit 4 to the opening 10.

At the opening 10 the screwdriver has a female threaded 30 that receives a tube 32 flanged at 34 and threaded to engage thread 30. A chuck member 36 is located in the housing by the flanged tube 32. The chuck member 36 comprises a tubular member having an upper flange 38 and a split tube bottom portion 40 as shown most clearly in FIG. 1. The member 36 has an external thread 42 and this is gripped by a cap 44 having an inclined inner surface 46 that acts to compress the split tube parts 40 together thus gripping a bit 4 in position. To facilitate the gripping the bits 4 are desirably provided with flanges 48 to engage in slots 50 in the chuck member 36 as most clearly shown in FIGS. 4 and 5. It should also be noted from FIGS. 4 and 5 that the chuck is desirably provided with smaller slots 52 so that the blade 4 of a slot screwdriver may fit through the chuck member 36 to enter the housing 2 when it is being returned from its useful position to its storage position.

Figure 3:
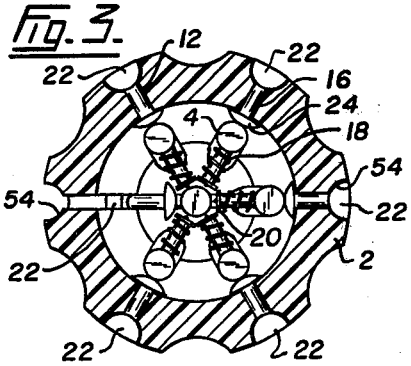
FIG. 3 is a section on the line 3—3 in FIG. 2.

As illustrated particularly in FIG. 3 the knobs 22 are desirably each provided in a recess 54 so that they do not damage the hand of the person using the screwdriver.

Figure 4:
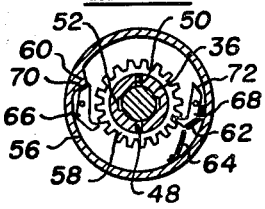
FIG. 4 is a section on the line 4—4 in FIG. 2.
Figure 5:
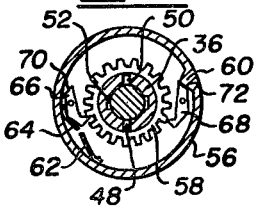
FIG. 5 is a section similar to FIG. 4.

As shown in FIGS. 2, 4 and 5 the tool of the present invention is desirably provided with a ratchet mechanism that first permits the user to select a direction, clockwise or counterclockwise, in which the tool will be useful. That is the tool will not drive when rotated in the other, undesired position. The ratchet mechanism is controlled by a ring 56 desirably having a knurled surface to facilitate gripping. The mechanism also includes a ratchet ring 58 attached to the chuck member 36 as shown particularly in FIGS. 4 and 5. The ring 56 has a cam surface 60 on its interior and is also provided with two leaf springs 62 and 64. Two pawls 66 and 68 are positioned in the space between the ring 56 and the ratchet ring 58 the pawls 66 and 68 are able to pivot independently of the ring 56, that is they are located preferably in the undersurface of flange 34.

In use, the device is operated as follows. First marking on the exterior of the device can indicate which screwdriver bit 4 is associated with which knob 22. Then the appropriate selection is made and the knob 22 associated with the screwdriver but 4 is pushed downwardly by the finger. The other, non-selected bits remain in position held by the combined action of the springs 18 and 24. The preselected blade 4 is moved to the correct position. The flanges 48 are engaged in the slots 50 and the cap 44 is then tightened on the thread 42 to locate the bit 4 in position. If it is desired to tighten a right hand threaded screw then the ring 56 is rotated to the position shown in FIG. 4, that is the ring 56 is rotated so that the cam 60 acts against an inclined surface 70 on the pawl 66 and moves the pawl 66 out of engagement from the ratchet 58. At the same time leaf spring 62 urges pawl 68 into engagement with the ratchet 58 thus preventing anticlockwise movement of the ratchet 58 relative to the pawl 68. If it is desired to loosen a right hand threaded screw then the ring 56 is rotated to the position shown in FIG. 5, that is the cam 60 acts against an inclined surface 72 on the pawl 68 to move that pawl 68 out of engagement with the ratchet 58. At the same time the leaf spring 64 on the inner surface of the ring 56 urges the pawl 66 into engagement with the ratchet 58 to restrict movement of the screwdriver to the anticlockwise direction.

When it is desired to replace a bit with another one from storage the chuck 44 is loosened, the position of the ratchet mechanism being immaterial, the knob 22 of the protruding bit is contacted and moved upwardly to the upper end of the longitudinal opening 12. It is retained there. If desired a further bit 4 may immediately be selected simply by pressing on the knob 22 associated with the bit and moving the bit 4 downwardly. The chuck 44 is then tightened, the ring 56 adjusted to the desired position and the screwdriver is ready for use.

The screwdriver of the present invention can provide a storage for a large number of bits—six are shown but many more could be used—and permits changing of the bit with extreme ease.

I claim:

1. A tool comprising a housing;

a plurality of bits located within the housing, each bit having a working end to protrude from the housing and an inner end located in the housing;

a pathway in each bit adjacent said inner end;

a first opening in the housing to allow a preselected bit to protrude;

means to grip the preselected bit;

a plurality of second openings, positioned circumferential of the housing and extending longitudinally of the housing;

a plurality of shafts, each extending through an associated second opening and through a pathway in a bit;

resilient means on each shaft urging each bit radially outwardly;

whereby a bit may be selected by pushing on its associated shaft and moving the shaft downwardly towards the first opening, the gripping means then being operated to grip the selected bit with its working end protruding from the first opening in the housing.

2. A tool as claimed in claim 1 in which each bit has a flange to facilitate gripping by the gripping means.

3. A tool as claimed in claim 1 in which the gripping means is a chuck.

4. A tool as claimed in claim 1 in which the bits are screwdriver blades.

5. A tool as claimed in claim 1 in which each shaft has a knob on its end external of the housing.

6. A tool as claimed in claim 1 in which the resilient means comprises a coil spring urging the bit outwardly; and a stop for the spring on the inner end of each shaft.

7. A tool as claimed in claim 6 having a leaf spring on the shaft to act against said coil spring to help retain a bit on a shaft without play.

8. A tool as claimed in claim 1 having a detachable top for the housing to allow changing of bits.

9. A tool as claimed in claim 1 in which the sides of the housing slope towards the first opening to guide the preselected fit to the first opening.

10. A tool as claimed in claim 1 including means to lock the tool so that it drives in either clockwise or anticlockwise direction but not both.

11. A tool as claimed in claim 11 in which the means to lock the tool comprises a ratchet and pawl mechanism, the ratchet being located on the exterior of the gripping means.

12. A tool as claimed in claim 11 in which the ratchet comprises a gear wheel surrounding the gripping means;

a ring surrounding and spaced from the gear wheel;

a cam formed on the inner face of the ring;

resilient urging means on the ring;

a first pawl and a second pawl movable relative to the ring; whereby rotation of the ring causes the resilient urging means to urge the first pawl to engage the ring and to restrict rotation of the ring, and thus of the bit, the clockwise direction while the cam forces the second pawl out of engagement with the ring, and counter rotation of the ring forces the resilient urging means to engage the second pawl to force it into engagement with the ring to restrict rotation to counterclockwise while the cam forces the first pawl out of engagement with the ring.

* * * * *